US005520286A

United States Patent [19]

Murakoshi et al.

[11] Patent Number: 5,520,286

[45] Date of Patent: May 28, 1996

[54] MONEY CASE WITH PARTITION PLATES

[75] Inventors: Akinobu Murakoshi, Shizuoka; Mitsugu Okawa, Osaka, both of Japan

[73] Assignee: Kabushiki Kaisha TEC, Shizuoka, Japan

[21] Appl. No.: 296,436

[22] Filed: Aug. 26, 1994

[30] Foreign Application Priority Data

Aug. 27, 1993 [JP] Japan ..... 5-46717 U

[51] Int. Cl.[6] ..... B65D 1/36; G07G 1/00

[52] U.S. Cl. ..... 206/561; 206/84; 206/449; 220/528; 235/22; 312/291

[58] Field of Search ..... 206/81, 84, 561, 206/449; 220/528; 312/211, 209, 291; 232/43.1; 235/22; 211/50, 55

[56] References Cited

U.S. PATENT DOCUMENTS

| | | | |
|---|---|---|---|
| 495,934 | 4/1893 | Foote | 206/81 |
| 542,014 | 7/1895 | Glaeser | 206/561 X |
| 821,350 | 5/1906 | Ferris | 206/81 |
| 1,266,708 | 5/1918 | Ozanne | 206/561 X |
| 1,383,570 | 7/1921 | Schnell | 206/449 |
| 1,857,305 | 5/1932 | Holliday | 206/561 |
| 1,875,695 | 9/1932 | Beard et al. | 220/528 X |
| 1,901,533 | 3/1933 | Preddey | 206/561 X |
| 2,508,981 | 5/1950 | Williams | 206/81 |
| 4,412,709 | 11/1983 | Ishii | 312/291 |
| 4,424,426 | 1/1984 | Ishii | 235/22 X |
| 5,058,765 | 10/1991 | Gomi et al. . | |

FOREIGN PATENT DOCUMENTS 2-217996 8/1990 Japan .

*Primary Examiner*—Bryon P. Gehman
*Attorney, Agent, or Firm*—Oblon, Spivak, McClelland, Maier & Neustadt

[57] ABSTRACT

An open-top case is provided wherein an inside portion of the open-top case is separated by partition plates in a lateral manner, whereby several bank note storage portions are provided in the open-top case. Several openings are provided in an upper region of the partition plates. Accordingly, money handling for bank notes can be done easily even if the bank notes are small sized. Because an upper region of each of the bank notes are exposed at the openings regardless of the size thereof, it is easy to touch the bank notes at the openings even for small sized bank notes. Also the bank notes are reliably supported by the partition plates since it is not necessary to provide a wide opening in the partition plates for easy access to bank notes.

8 Claims, 4 Drawing Sheets

MONEY CASE WITH PARTITION PLATES

BACKGROUND OF THE INVENTION

1. Field of the Invention

The present invention relates to a money case for storing money.

2. Description of the Related Art

A prior art example of a money case to be utilized for a drawer of an electronic cash register are disclosed in U.S. Pat. No. 5,058,765 which is one of a patent family of Japanese laid open publication Heisei 2-217996 (JPA 2-217996). This prior art example will be described according to FIGS. 4 to 8. As shown in FIG. 4, an open-front housing 1 contains an open-top case 2 capable of sliding out of and into in the horizontal direction. As shown in FIG. 5, a plurality of coin cases 3 and a plurality of partition plates 4 supporting the bank notes P are detachably provided in an inside of the open-top case 2. The partition plate 4 forms a plurality of bank note storage portions 5 in the open-top case 2 by partitioning the inside of the open-top case 2. Thus, it is possible to store the bank notes P sorted according to their kind into respective bank note storage portions 5.

With such money case, money handling for the bank notes P can be done easily as compared with other conventional type drawers holding the bank note horizontally. The base area for installation also can be reduced as compared with such conventional type drawers.

The problem of the prior art as mentioned above will be described as follows. It is necessary to store not only a single kinds of bank notes but also various kind of bank notes having different sizes in the money case. However, with above mentioned money case, the bank note storage portions 5 are formed with uniform dimensioning in order to reduce the cost of production, etc. Thus, money handling from the bank note storage portions 5 is worse for small size of bank notes. In order to solve this problem, as shown in FIG. 6., a partition plate 4 having an opening 4*a* is originated. U.S. Pat. No. 5,058,765 also discloses such partition plate 4. With such partition plate 4, money handling for the small size of the bank notes P can be done easily since a top region of the bank notes P is exposed to the exterior at the opening 4*a*.

However, as shown in FIG. 7, due to the small size of the bank notes P, such notes are not exposed to the extension at the opening 4*a* if such bank notes P is stored at the corner of the bank note storage portion 5. In order to solve this problem, as shown in FIG. 8, it is proposed to expand the opening 4*a* in the width direction thereof. However, it is anticipated that such wide opening 4*a* can not support the bank notes P sufficiently, so that the bank notes P bends at the opening 4*a*.

Furthermore, each bank note partition portion 5 is formed with the same depth. Thus, the small sized bank notes P are not exposed at the opening 4*a* if such bank notes P do not reach the opening 4*a*. Therefore, money handling for bank notes P from the bank note storage portions 5 is worse for such small sized bank notes P.

SUMMARY OF THE INVENTION

The first object of the present invention is to make putting in and taking out of bank notes easier regardless of the size thereof.

The second object of the present invention is to support bank notes surely by a partition plate.

The third object of the present invention is to prevent the misplacing of coins from a coin storage portion to a bank note storage portion.

The fourth object of the present invention is to improve money handling for bank notes.

The fifth object of the present invention is to improve safety against theft.

In a money case according to a first aspect of the present invention which includes an open-top case, a partition plate partitions off an inside of the open-top case crosswise, whereby several bank note storage portions are formed so as to be separated by the partition plate inside the open-top case, and several openings are formed at an upper region of the partition plate. Accordingly, money handling for bank notes can be done easily even if the bank notes are small sized. Since the upper region of bank notes are exposed at the openings regardless of the size thereof, it is easy to touch the bank notes at the openings even if bank notes are small sized. The bank notes are supported surely by the partition plate since it is not necessary to provide a wide opening for easy access to bank notes.

In a money case according to a second aspect of the present invention which includes an open-top case, the partition plate partitions off the inside of the open-top case in a crosswise manner, whereby several bank note storage portions are formed in the interior of the open-top case, an opening is formed at an upper region of the partition plate, and a supporting member is provided at the opening, separating the opening into at least two parts. Accordingly, money handling of bank notes can be done easily even if the bank notes are small sized. It is because an upper portion of the bank notes are exposed at the openings regardless of size thereof that it is easy to touch bank notes at the openings even if bank notes are small sized. The bank notes are supported surely by means of the supporting member.

In a money case according to a second aspect of the present invention there is provided an open-top case, a partition plate partitioning off the inside of the open-top case crosswise, whereby several bank note storage portions are formed at each of the parts to be separated by the partition plate in the inside of the open-top case, and means for forming the bank note storage portions differ in depth from one another. Accordingly, money handling for bank notes can be done easily even if the bank notes are small sized. It is because that such small size bank notes can be stored in the bank notes storage portion having a shallow depth.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
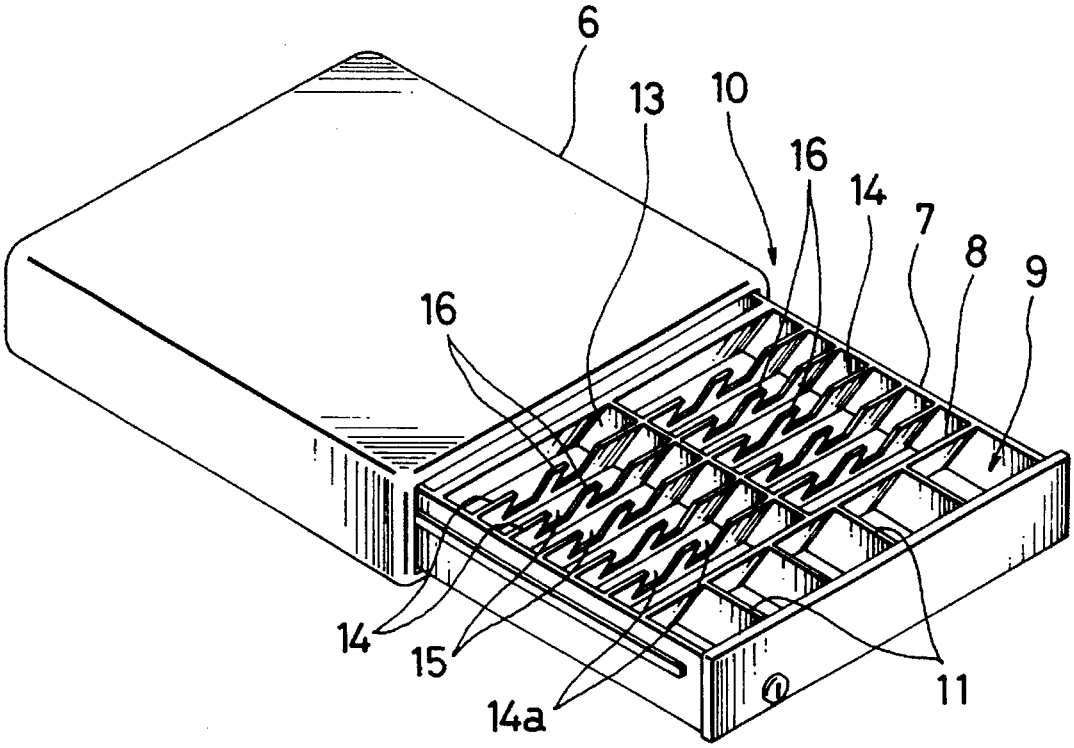
FIG. 1 is a perspective view of a money case showing the first preferred embodiment of the present invention.

A first preferred embodiment of the present invention will now be described with reference to FIGS. 1 and 2. A money case includes an open-front housing 6, and an open-top case 7 capable of sliding out of and into the open-front housing 6 in horizontal direction. The interior of the open-top case 7 is separated by an area partition plate 8 disposed laterally into a coin storage area 9 and a bank note storage area 10. The coin storage area 9 is disposed in the front area of the open-top case 7. The coin storage area 9 is further separated by a plurality of coin partition plates 11 into a plurality of coin storage portions 12. The coin partition plate 11 crosses the area partition plate 8 at the right angles. As shown in FIG. 2, the coin storage portions 12 have bottoms to be continuously curbed toward the front end of the open-top case 7, so that coins stored therein may be easily removed.

The bank note partition area 10 is separated into two parts by second partition plate 13 partitioning the inside of the open-top case 7 lengthwise. The second partition plate 13 crosses the area partition plate 8 at right angles. Partition plate 13 is further separated into a plurality of bank note storage portions 15 by a plurality of partition plates 14 partitioning the inside of the open-top case 7 crosswise. Thus, it is possible to store bank notes P sorted according to their proper denominations into respective bank note storage portions 15.

Each of the partition plates 14 is disposed with narrow pitches for the purpose of supporting the bank notes P vertically. The partition plate 14 and the area partition plate 8 are also disposed with a narrow pitch for the same purpose. The partition plate 14 and the area partition plate 8 incline to the front of the open-top case 7 for the purpose of depositing and withdrawing of the bank notes P easily.

Two openings **14*a* are formed at the upper region of the partition plate 14 for the purpose of depositing and withdrawing the bank notes P easily. That is, an opening is formed at an upper region of the partition plate 14 and a supporting member 16 is formed at the center of the opening so as to divide the opening into two parts, so that two opening 14*a* are formed. Such openings 14*a* are not formed in the area partition plate 8 so as to prevent intrusion of coins from the coin storage portion 12 into the bank note storage portion 15**.

Figure 2:
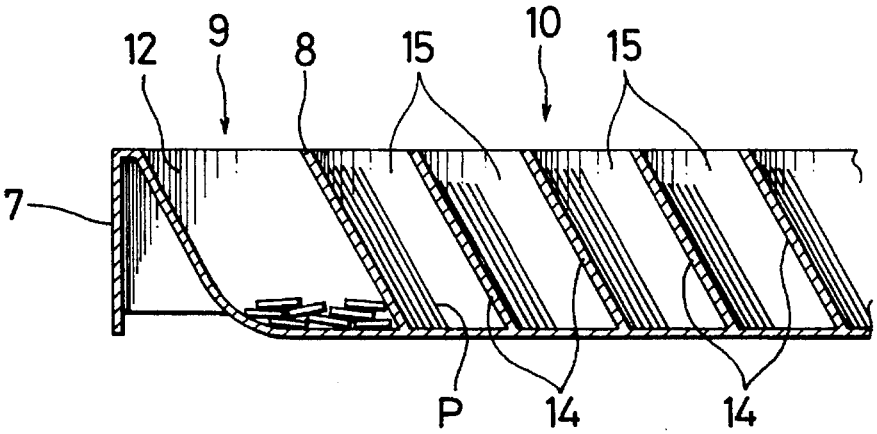
FIG. 2 is a longitudinal section view of an open-top case to be used with the money case shown in FIG. 1.

In operation, when the open-top case 7 is drawn out as shown FIG. 1, the coin storage portion 12 and bank note storage portion 15 appear. Then it is possible to deposit and withdraw the coins and bank notes P.

With the money case of the first embodiment, the openings **14*a* are provided in the partition plate 14. These openings 14*a* enable deposit and withdrawal of the bank notes P easily since the openings 14*a* allow intrusion of fingers into the partition plate 14 supporting the bank notes P. Even if the bank notes P are small sized, money handling for the bank notes P can be done easily. This is because that two openings 14*a* are provided along the upper region of the partition plate 14, so that such small bank notes P are exposed at one opening 14*a* at least. Moreover, the bank notes P are supported by the supporting member 16, so that the bank notes P are surely supported by the partition plate 14 and the area partition plate 8**.

Consequently, if the money case described above is utilized for a drawer of an electronic cash register, the drawer will increase efficiency in money handling since the bank notes P can be handle more quickly.

Furthermore, it is possible to provide a lid covering the top of the open-top case 7 instead of the housing 6 in the first preferred embodiment.

Figure 3:
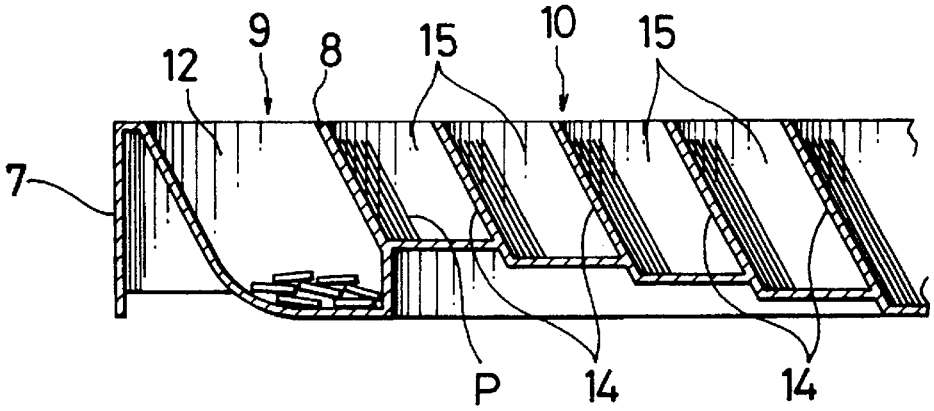
FIG. 3 is a longitudinal section view of an open-top case showing the second preferred embodiment of the present invention.
Figure 4:
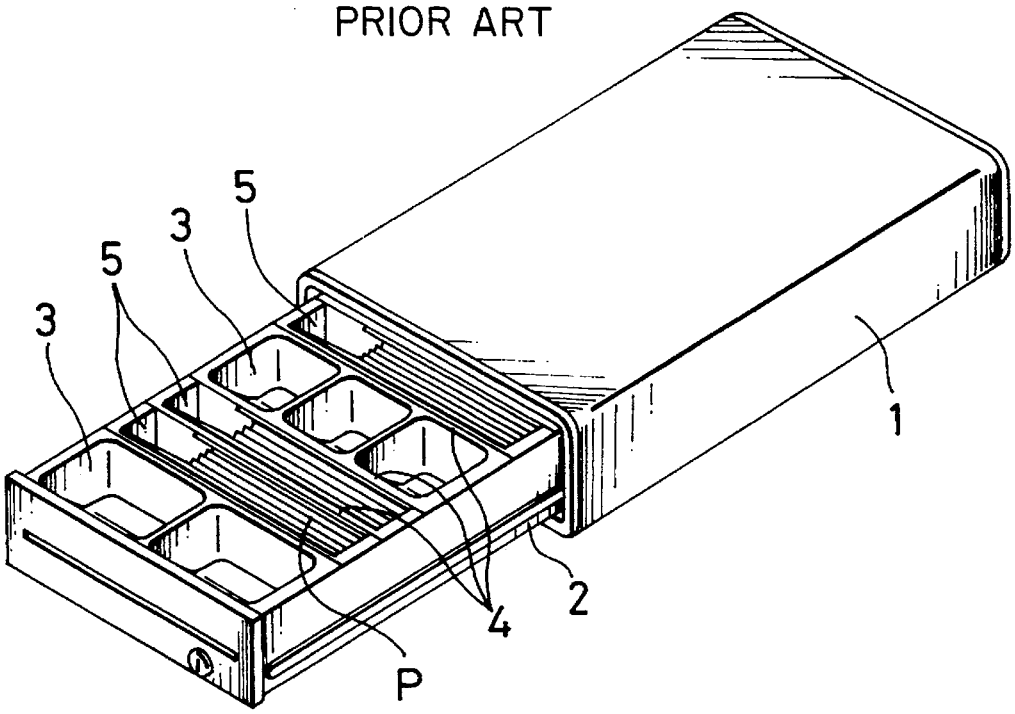
FIG. 4 PRIOR ART
FIG. 4 is a perspective view of a prior money case.
Figure 5:
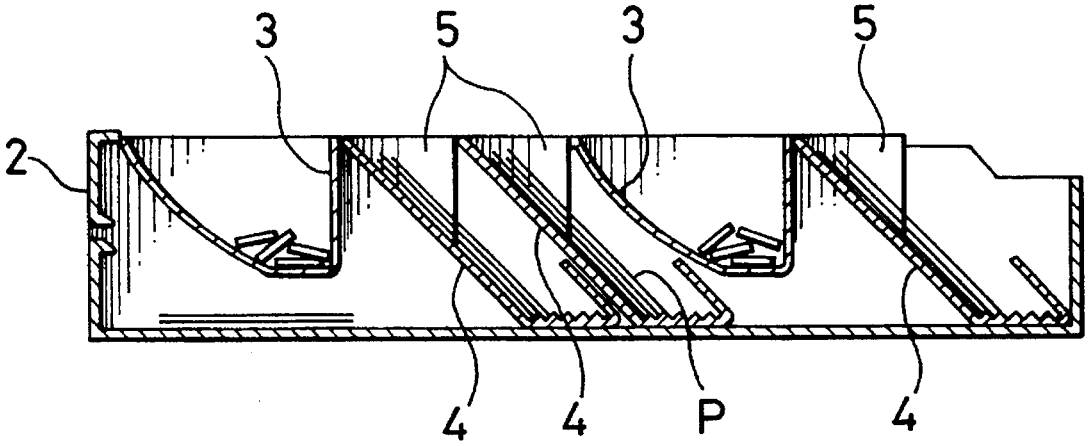
FIG. 5 PRIOR ART
FIG. 5 is a longitudinal section view of an open-top case to be used with the money case shown in FIG. 4.
Figure 6:
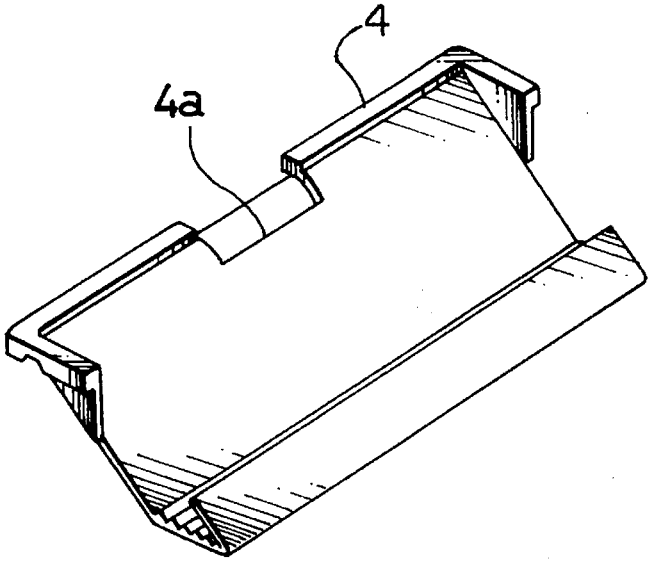
FIG. 6 PRIOR ART
FIG. 6 is a perspective view of a partition plate to be used with the money case shown in FIG. 4
Figure 7:
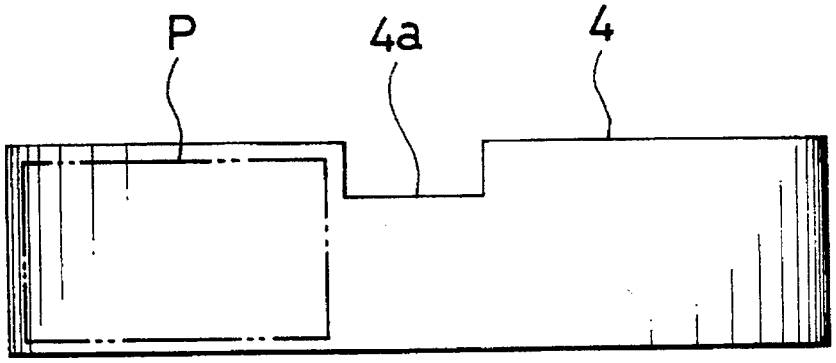
FIG. 7 PRIOR ART
FIG. 7 is a front view of the partition plate shown in FIG. 6.
Figure 8:
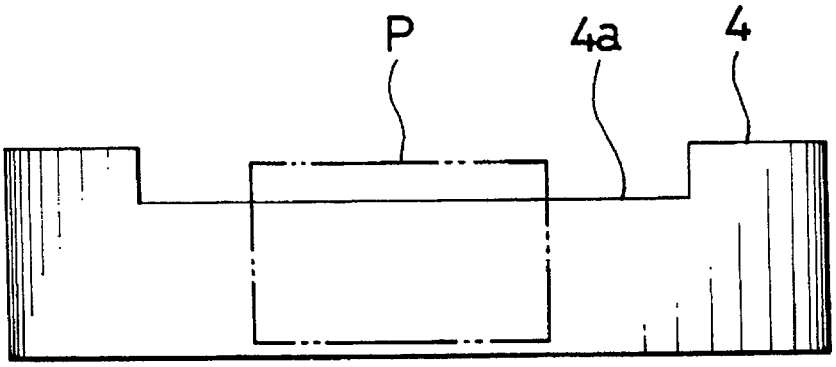
FIG. 8 PRIOR ART
FIG. 8 is a front view of a partition plate.

A second preferred embodiment of the present invention will now be described with reference to FIG. 3. In the following description, the same structural parts as the first preferred embodiment will be denoted by the same reference numerals. Basically, the money case of the second preferred embodiment has the same structure as the money case of the first preferred embodiment except that the bank note storage portions 15 are formed so as to differ in depth from one another. That is, the bottom of the bank note storage portions 15 differ in the height from one another. As shown in FIG. 3, the bottoms of the bank note storage portions 15 are arranged so as to be higher approaching the front.

In operation, the size of each of the bank notes P are made even with one another in the bank note storage portions 15 by storing the bank notes P into respective bank note storage portions 15. Thus, even if the bank notes P are small sized, money handling for the bank notes P can be done easily.

The bank note storage portions 15 are formed so as to be progressively more shallow in a direction towards to the front portion of the money case. Accordingly, the bank notes P can be arranged conveniently. Because, in general, the size of the bank notes P is determined according to a sum of money, the size of the bank notes P increases proportionally with respect to value of the money. Moreover, safety against theft is improved because the bank notes P being large sum of money are stored in a deep portion of the open-top case 6.

Furthermore, it is possible for the partition plate 14 to have no openings **14*a***, unlike the first embodiment.

Obviously, numerous modifications and variations of the present invention are possible in light of the above teachings. It is therefore to be understood that within the scope of the appended claims, the invention may be practiced otherwise than as specifically described herein.

What is claimed is:

1. A money case for storing bank notes, comprising:

an open-top case;

a plurality of partition plates partitioning off an inside portion of said open-top, said partition plates being positioned between a front and rear end of the case wherein a plurality of bank note storage portions are formed by said partition plates and an upper region of each of said partition plates has a pair of openings formed therein; and a support member separating each of said pair of openings of each partition plate so as to assist in handling of bank notes in the bank note storage portions.

2. A money case according to claim 1, wherein said partition plates are inclined towards the front end of the case.

3. A money case according to claim 1, which comprises a housing wherein said open-top case is slidable out of and into said housing in a horizontal direction.

4. A money case according to claim 1, wherein said case includes a second coin storage portion at a front portion of said bank note storage portions, wherein an additional partition plate is provided which partitions off said bank note storage portions from said coin storage portion.

5. A money case according to claim 1, which comprises an additional partition plate partitioning off said open-top case in a direction from the front end to the rear end of the case.

6. A money case as claimed in claim 1 wherein a plurality of bank note storage portions are respectively formed inside of said open-top case, said bank note storage portions have bottom portions which differ in depth from one another, said bank note storage portions progressively have a shallower depth approaching a front portion of said open-top case and wherein said partition plates are inclined towards a front portion of said money case.

7. A money case according to claim 6, which comprises a housing containing said open-top case wherein said case is slidable out of and into said housing in a horizontal direction.

8. A money case according to claim 6, which comprises an additional partition plate partitioning off an inside portion of said open-top case along a length dimension of said open-top case.

* * * * *